US008356436B2

(12) United States Patent
Horikiri

(10) Patent No.: US 8,356,436 B2
(45) Date of Patent: Jan. 22, 2013

(54) INFORMATION DISPLAY PANEL AND ELECTRONIC SHELF LABEL

(75) Inventor: Keiichi Horikiri, Chiba (JP)

(73) Assignees: Seiko Instruments Inc. (JP); Toshiba Tec Corporation (JP)

( * ) Notice: Subject to any disclaimer, the term of this patent is extended or adjusted under 35 U.S.C. 154(b) by 37 days.

(21) Appl. No.: 12/998,603

(22) PCT Filed: Oct. 9, 2009

(86) PCT No.: PCT/JP2009/067677

§ 371 (c)(1),
(2), (4) Date: Jun. 6, 2011

(87) PCT Pub. No.: WO2010/052995

PCT Pub. Date: May 14, 2010

(65) Prior Publication Data

US 2011/0239509 A1 Oct. 6, 2011

(30) Foreign Application Priority Data

Nov. 7, 2008 (JP) ..... 2008-286666

(51) Int. Cl.
*G09F 3/18* (2006.01)

(52) U.S. Cl. ..... 40/661.08; 40/124.01; 40/124.09

(58) Field of Classification Search ..... 40/661.08, 40/124.01, 124.05, 124.09, 124.14
See application file for complete search history.

(56) References Cited

U.S. PATENT DOCUMENTS

| | | | | |
|---|---|---|---|---|
| 3,364,605 | A * | 1/1968 | Cross | 40/124.09 |
| 7,055,274 | B2 * | 6/2006 | Fast et al. | 40/661.03 |
| 7,992,334 | B1 * | 8/2011 | Engelby et al. | 40/661.03 |
| 2009/0300952 | A1 * | 12/2009 | Hayes | 40/124.07 |

FOREIGN PATENT DOCUMENTS

| | | |
|---|---|---|
| JP | 3139238 | 2/2008 |
| JP | 4111757 | 7/2008 |

* cited by examiner

*Primary Examiner* — Gary Hoge
(74) *Attorney, Agent, or Firm* — Adams & Wilks

(57) ABSTRACT

An information display panel is configured to be held by a shelf label for displaying information. The information display panel has a display body portion for displaying the information and a holding portion formed along one edge of the display body portion and having a pair of slits. The holding portion is configured for insertion into a through-hole portion of the shelf label so as to form steps in the respective slits by which the holding portion is. engaged with the through-hole portion of the shelf label to thereby hold the information display panel.

18 Claims, 13 Drawing Sheets

INFORMATION DISPLAY PANEL AND ELECTRONIC SHELF LABEL

CROSS-REFERENCE TO RELATED APPLICATIONS

This application is a U.S. national stage application of International Application No. PCT/JP2009/067677 filed Oct. 9, 2009, claiming a priority date of Nov. 7, 2008, and published in a non-English language.

BACKGROUND OF THE INVENTION

1.Technical Field

The present invention relates to an information display panel and a shelf label, which are used for displaying a product price, character information, and the like in a retail store and the like.

2.Background Art

In recent years, in a retail store such as a supermarket, electronic shelf labels that display product prices have been attached to a product display shelf so that products in the store are controlled centrally. For example, a price of a product that changes on a daily or weekly basis is transmitted as a signal to an electronic shelf label of the target product, and accordingly price display can be changed easily and efficiently. To such an electronic shelf label, a detachable information display panel for displaying characters and numerals is attached particularly for the purpose of attracting customers' attention to products on sale or the like (see, for example, PTL 1).

FIG. 14 is a perspective view illustrating an example of the conventional information display panel described in PTL 1.

Specifically, in FIG. 14, reference symbol 100 represents an information display panel and reference symbol 101 represents a casing for housing a shelf label. The casing 101 is provided with an insertion slot 103 having a locking protrusion 102. Meanwhile, the information display panel 100 has a display body portion 104 constituting a card case portion to which a card having, for example, character information may be inserted. At the bottom edge portion of the display body portion 104, there is provided a holding piece 106 in which a locking hole 105 engageable with the locking protrusion 102 on the casing side is formed. The holding piece 106 is folded downward in two at the center portion thereof so that the folded parts thereof overlap with each other to serve as an upper insertion piece 106*a* and a lower insertion piece 106*b*. When the holding piece 106 is inserted into the insertion slot 103 from the folded portion side, the locking protrusion 102 engages with the locking hole 105, and accordingly the information display panel 100 is mounted on the casing 101. In other words, the holding piece 106 expands outward due to an elastic action produced by folding, with the result that the upper insertion piece 106*a* and the lower insertion piece 106*b* are fitted into the insertion slot 103 so as to push out the upper and lower surfaces located inside the insertion slot 103 due to the elastic action, and the locking protrusion 102 engages with the locking hole 105. Accordingly, the information display panel 100 is prevented from falling off.

Patent Literature

[PTL 1] JP 4111757 B

However, the conventional attachment structure for the information display panel has the following problems.

That is, in the structure of PTL 1 as illustrated in FIG. 14, the locking hole 105 and the locking protrusion 102 engage with each other at a point, and hence the holding piece 106 (information display panel 100) rocks, that is, rotates in a horizontal direction about the engaging portion. As a result, there is a trouble that the information display panel 100 is displaced and its display is misoriented, which leads to a problem with stability of the holding portion of the information display panel 100.

Further, it is necessary to form the locking protrusion 102 in the insertion slot 103 on a side on which the information display panel 100 is to be inserted, that is, the casing 101 side. As a result, the process therefor requires much labor and time.

The present invention has been made in view of the above-mentioned problems, and it is therefore an object thereof to provide an information display panel and a shelf label, which have structure that allows stability of a holding portion to be enhanced and a process to be facilitated.

SUMMARY OF THE INVENTION

In order to achieve the above-mentioned object, the present invention provides an information display panel to be held by a through-hole portion provided in a shelf label, the information display panel including: a display body portion capable of displaying arbitrary information; an insertion base end portion provided continuously to a bottom edge portion of the display body portion; a foldable piece extending from the insertion base end portion in a direction along the bottom edge portion; and a plurality of slits formed in at least one of the insertion base end portion and the foldable piece so as to be in parallel to each other along the bottom edge portion, in which the insertion base end portion is bent with respect to the display body portion along a boundary line between the insertion base end portion and the display body portion, and the foldable piece is folded so as to overlap with the insertion base end portion, to thereby form a holding portion that can be inserted into the through-hole portion, and in which the plurality of slits are arranged in at least one of upper and lower surfaces of the holding portion.

Further, the present invention provides a shelf label including a through-hole portion for holding the above-mentioned information display panel.

In the present invention, the holding portion of the information display panel is inserted into the through-hole portion provided in the shelf label, and accordingly the information display panel can be held on the shelf label. With this structure, it is possible to display character information and the like on the display body portion independently of the price display on the shelf label. Further, the foldable piece is folded so as to overlap with the insertion base end portion. Accordingly, the thickness dimension of the holding portion is increased and, due to the folding, elastic force is applied in such a direction as to push out the through-hole portion. In other words, a gap is eliminated between the through-hole portion and the holding portion, resulting in an improved engaging state of the two portions. Further, the through-hole portion is located between the two slits. With this structure, part of the holding portion located between the slits is pressed by the through-hole portion in such a direction as to decrease the thickness dimension thereof. As a result, steps are formed in the slit parts. Therefore, the insertion of the holding portion is regulated by the step of one of the slits, while the holding portion is prevented from falling off by the step of the other one of the slits.

Moreover, the steps formed by the slits form lines and abut against the through-hole portion along the lines. Accordingly, rocking of the holding portion, that is, rotation of the holding portion in the horizontal direction with respect to the through-hole portion, can be regulated.

Further, in the information display panel according to the present invention, the holding portion (insertion base end portion and foldable piece) can be arranged along the bottom edge portion of the display body portion, and hence the holding portion can be formed easily by, for example, slitting the information display panel in the state of the rectangular shape in the portion between the display body portion and the foldable piece. Further, there can be realized such simple engagement structure that formation of the slits in part of the holding portion and other processes do not require much labor and time.

Further, in the information display panel according to the present invention, it is preferred that the foldable piece be folded at least twice in a direction extending from the insertion base end portion.

In the present invention, the foldable piece has a double or more fold with respect to the insertion base end portion. Accordingly, the thickness of the holding portion can be increased further and the holding portion can engage with the through-hole portion of the shelf label with no gap.

Further, in the information display panel according to the present invention, it is preferred that at least two of the plurality of slits have a distance therebetween with substantially the same dimension as a linear dimension of the through-hole portion.

In the present invention, there is obtained an engaging state, in which the steps formed by the two slits abut against the through-hole portion and are locked while the holding portion, which is in the state in which the foldable piece is folded so as to overlap with the insertion base end portion, is inserted into the through-hole portion. Accordingly, the displacement in the direction in which the holding portion is inserted into the through-hole portion can be suppressed by the holding portion more reliably, resulting in enhanced stability of the holding state.

According to the information display panel and the shelf label of the present invention, when the holding portion, which has an elastic action produced by folding the foldable piece, is inserted into the through-hole portion of the shelf label, the through-hole portion and the holding portion are locked by the steps of the slit parts formed by pressing part of the holding portion in such a direction as to decrease the thickness dimension thereof by the through-hole portion, which can prevent the holding portion from falling off from the through-hole portion, resulting in an improved engaging state thereof. Further, the steps of the slits abut against the through-hole portion along the lines and enter the locked state. Accordingly, rotation of the holding portion in the horizontal direction with respect to the through-hole portion is regulated, which eliminates displacement due to rocking and enhances stability of the holding portion.

Further, there is obtained simple engagement structure in which the slits are only formed in part of the holding portion, and accordingly, for example, there is no need to form a protrusion in any one of the through-hole portion and the holding portion, which provides an advantage of facilitating the process.

DETAILED DESCRIPTION OF THE INVENTION

Hereinbelow, referring to FIGS. 1 to 10, description is given of an information display panel and a shelf label according to a first embodiment of the present invention.

Figure 1:
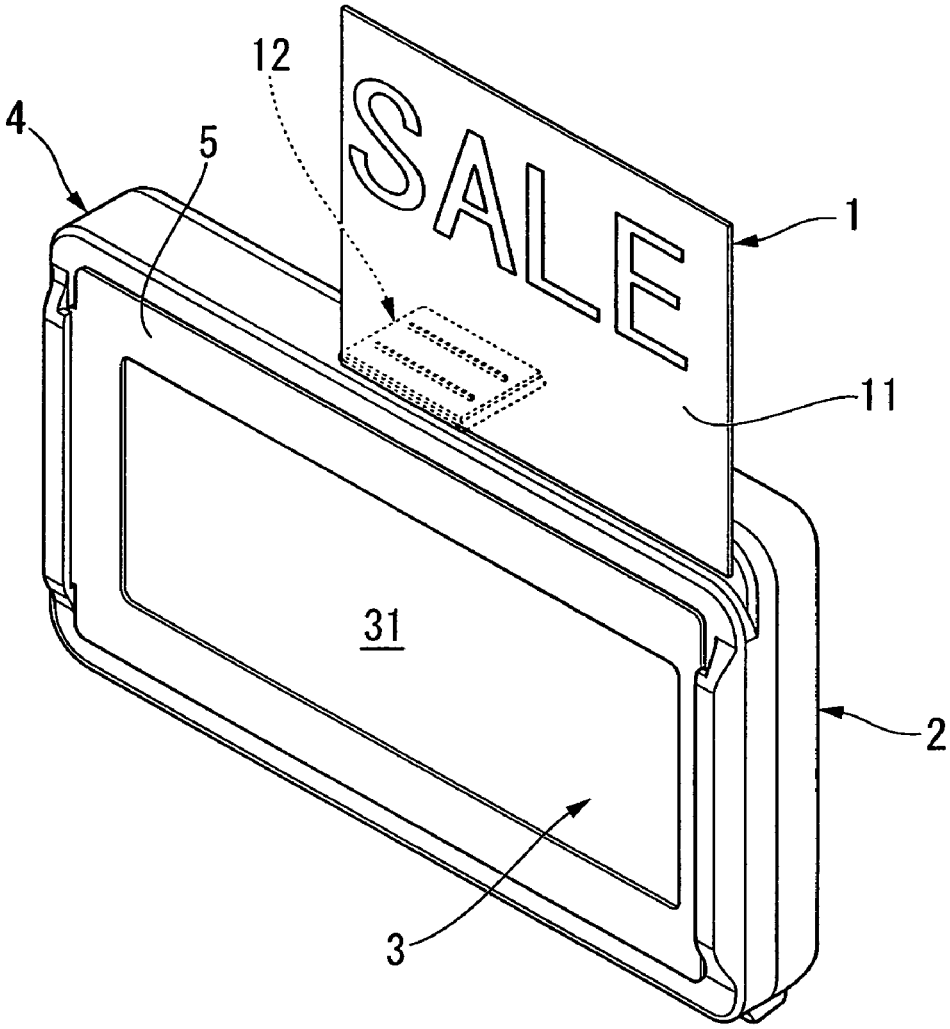
FIG. 1 is a perspective view illustrating a schematic structure of an information display panel mounted on an electronic shelf label according to a first embodiment of the present invention.
Figure 2:
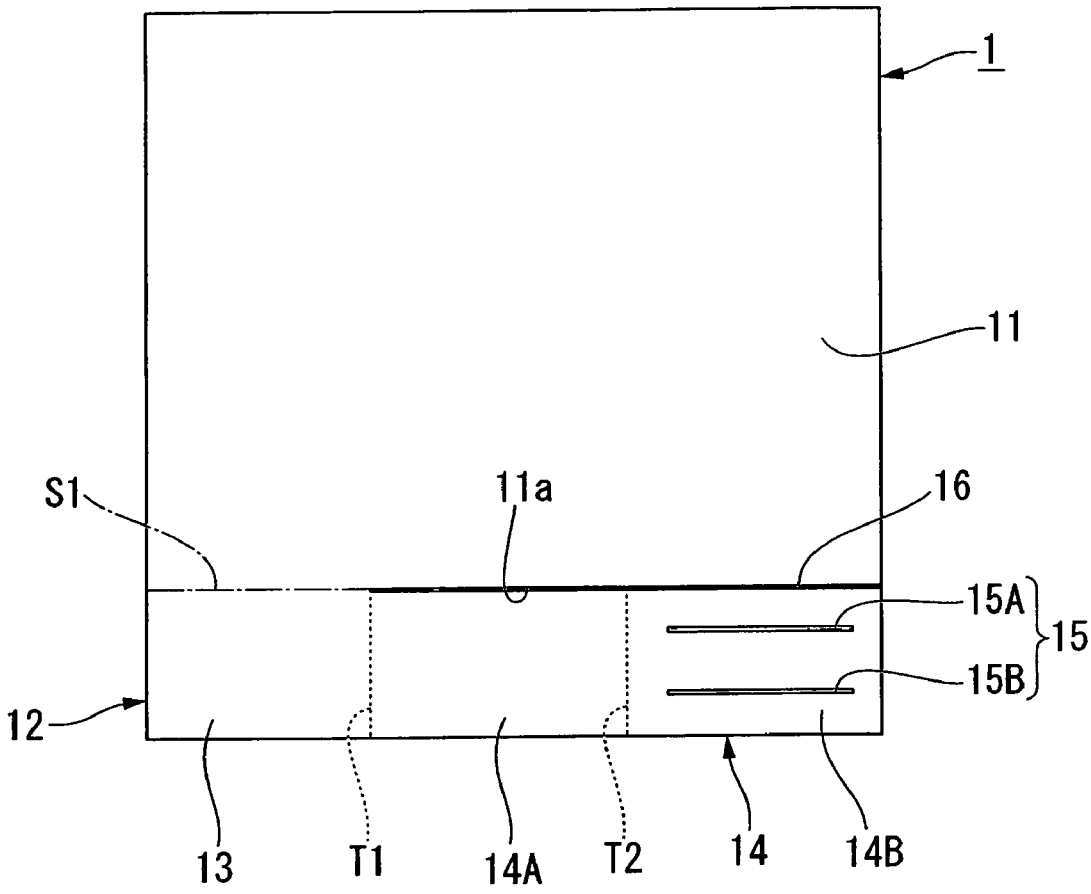
FIG. 2 is a front view of the information display panel.
Figure 3:
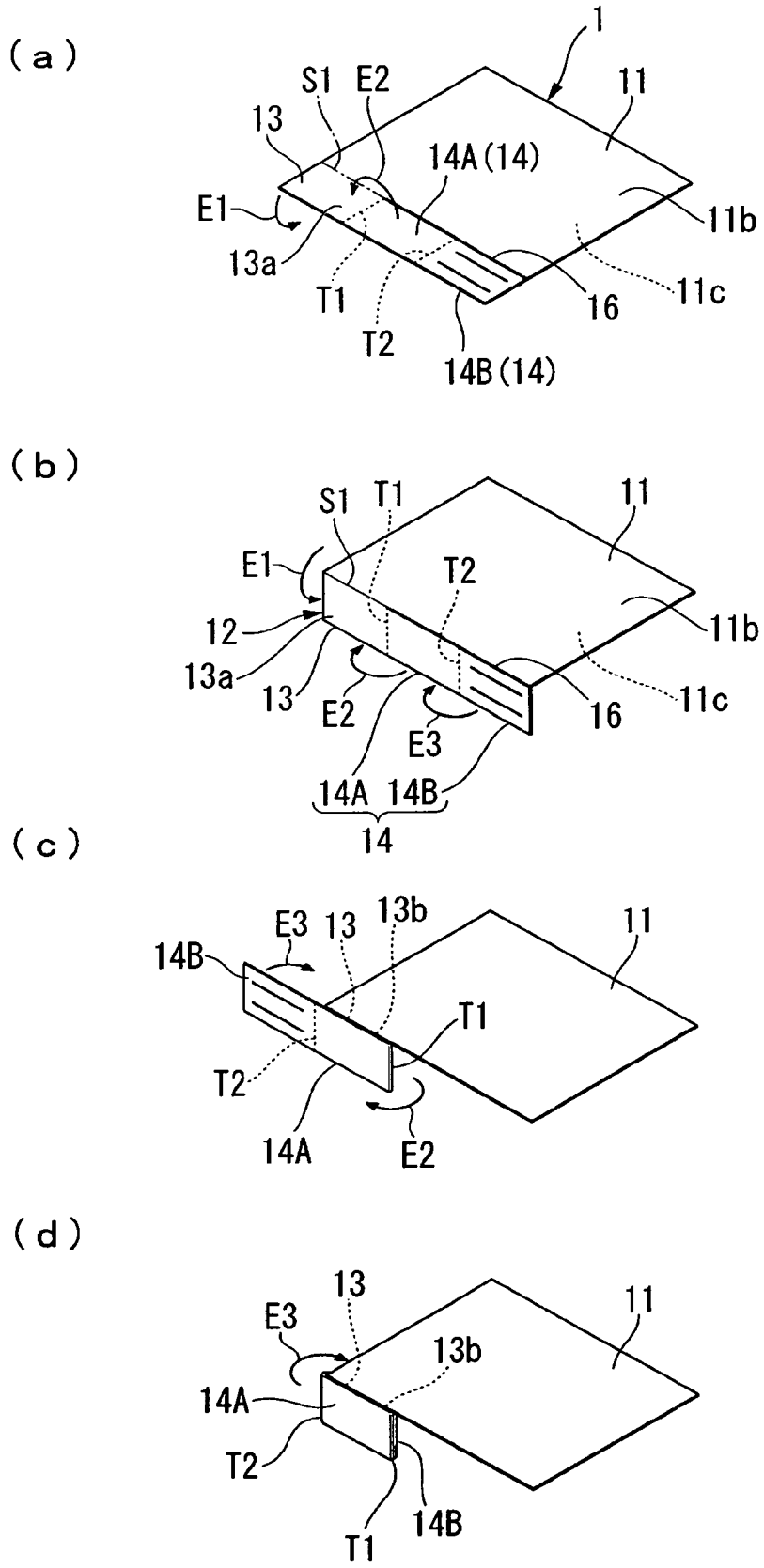
FIGS. 3(*a*) to 3(*d*) are views illustrating procedures of forming a holding portion of the information display panel.
Figure 4:
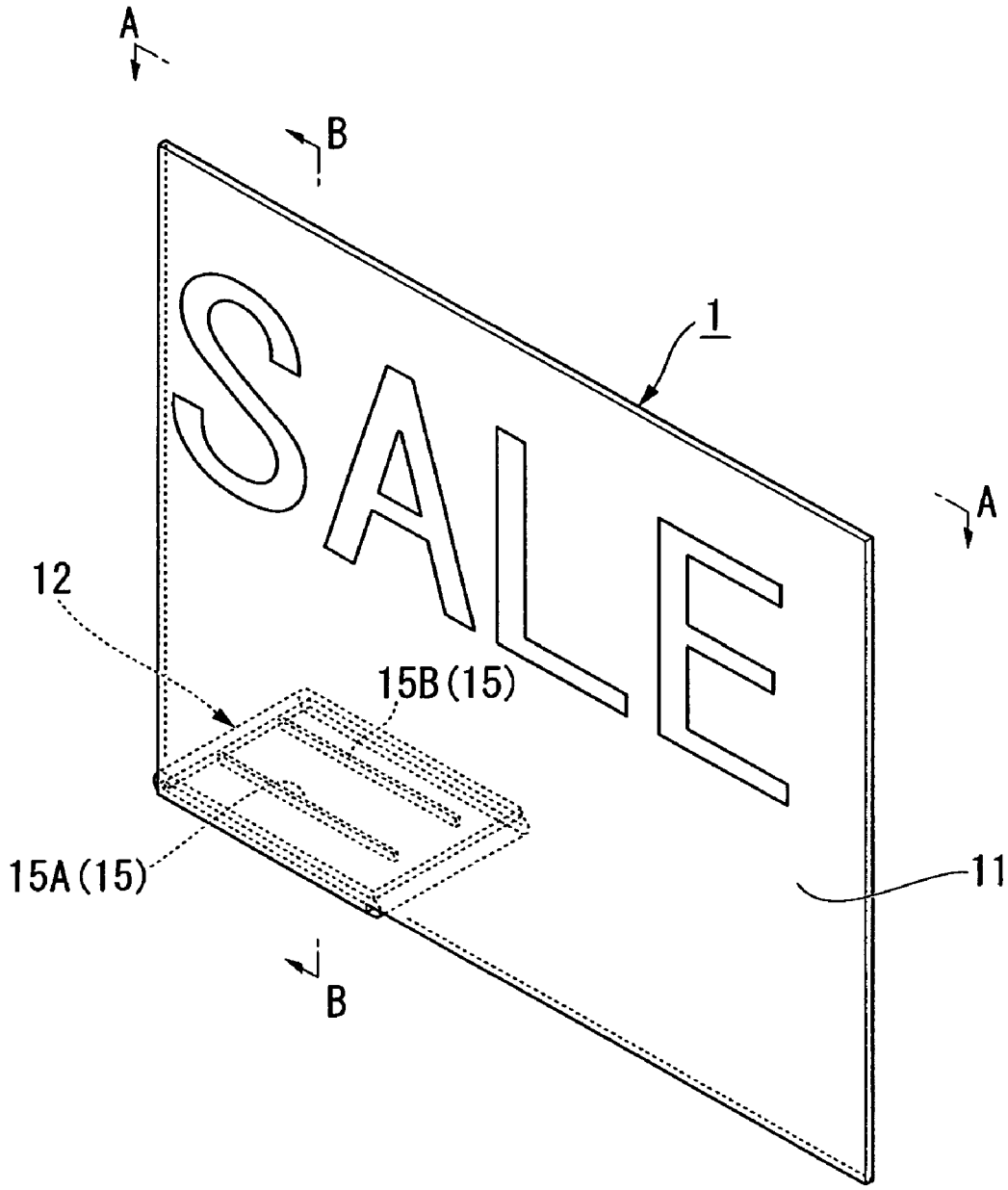
FIG. 4 is a perspective view of the information display panel in a state in which the holding portion is formed.
Figure 5:
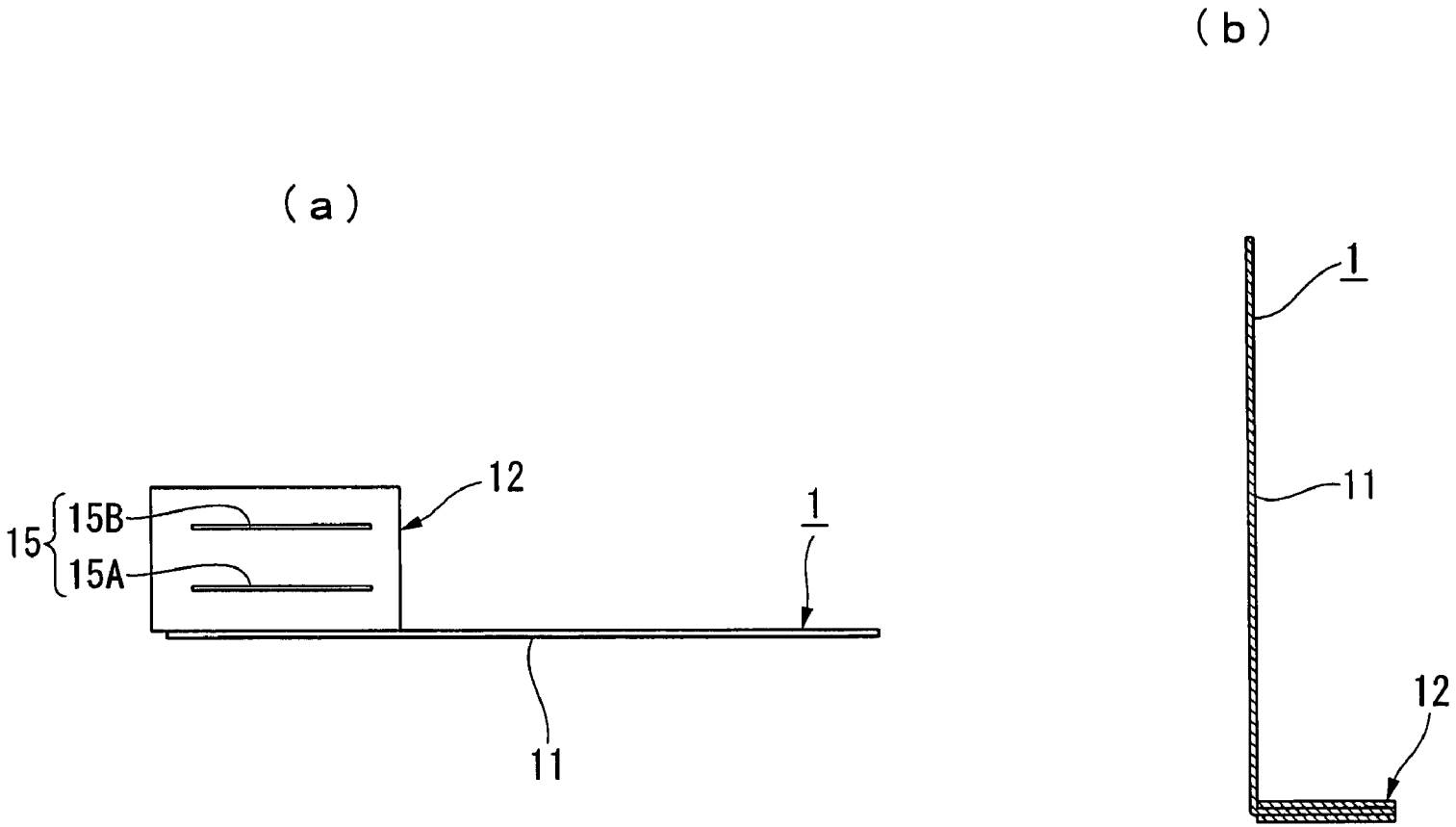
FIG. 5(*a*) is a view taken along the arrow A-A of FIG. 4, and FIG. 5(*b*) is a sectional view taken along the arrow B-B of FIG. 4.
Figure 6:
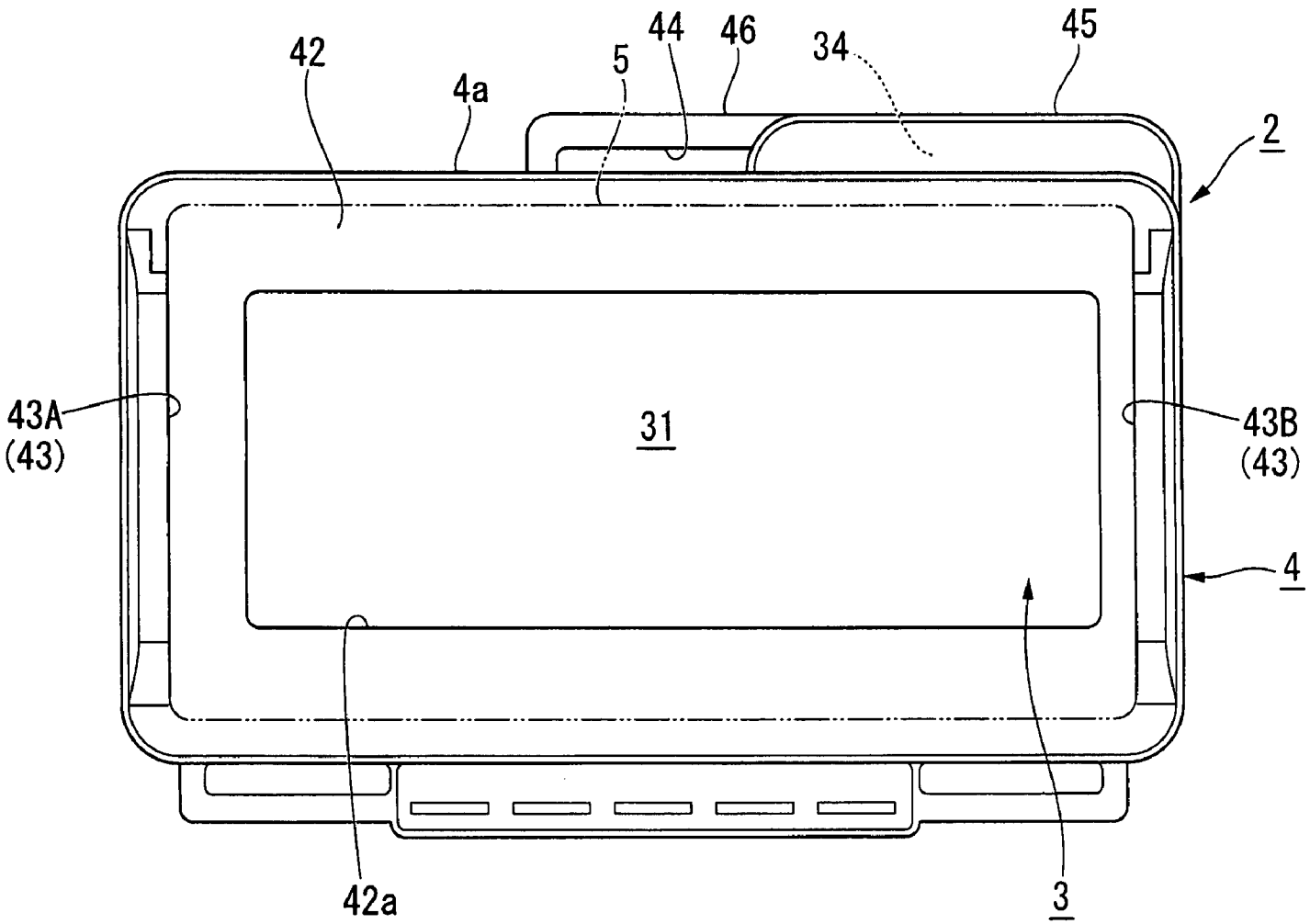
FIG. 6 is a front view of the electronic shelf label.
Figure 7:
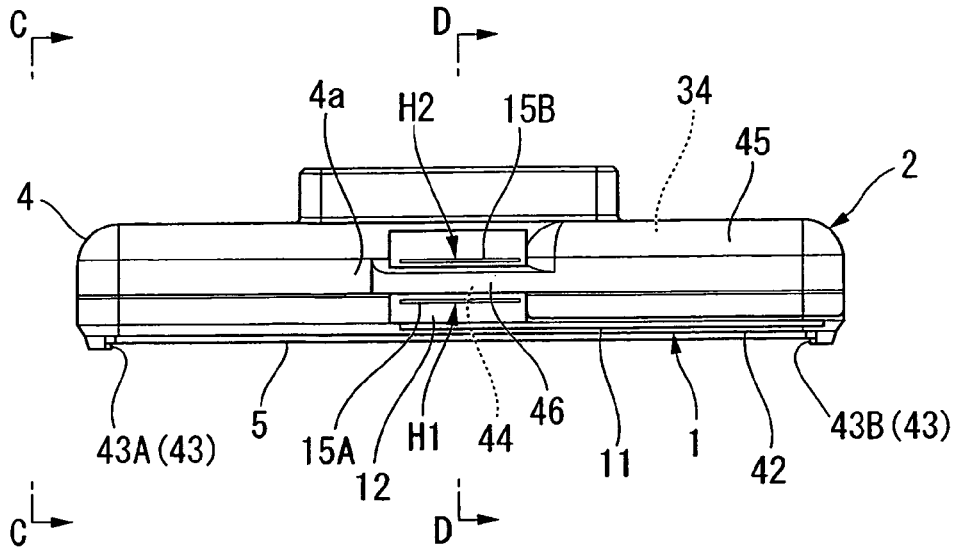
FIG. 7 is a top view of FIG. 1.
Figure 8:
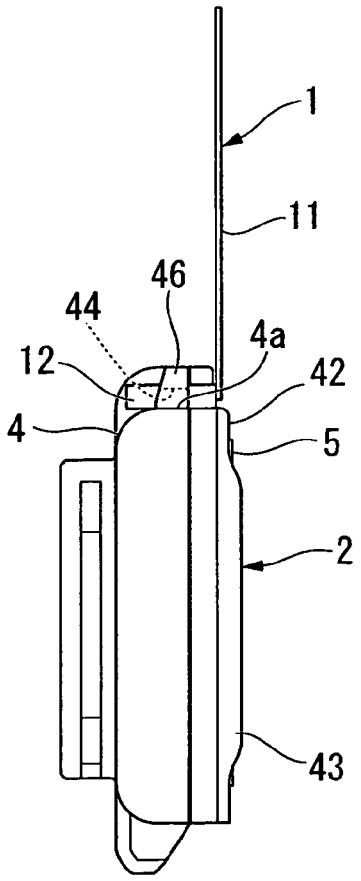
FIG. 8 is a view taken along the arrow C-C of FIG. 7.
Figure 9:
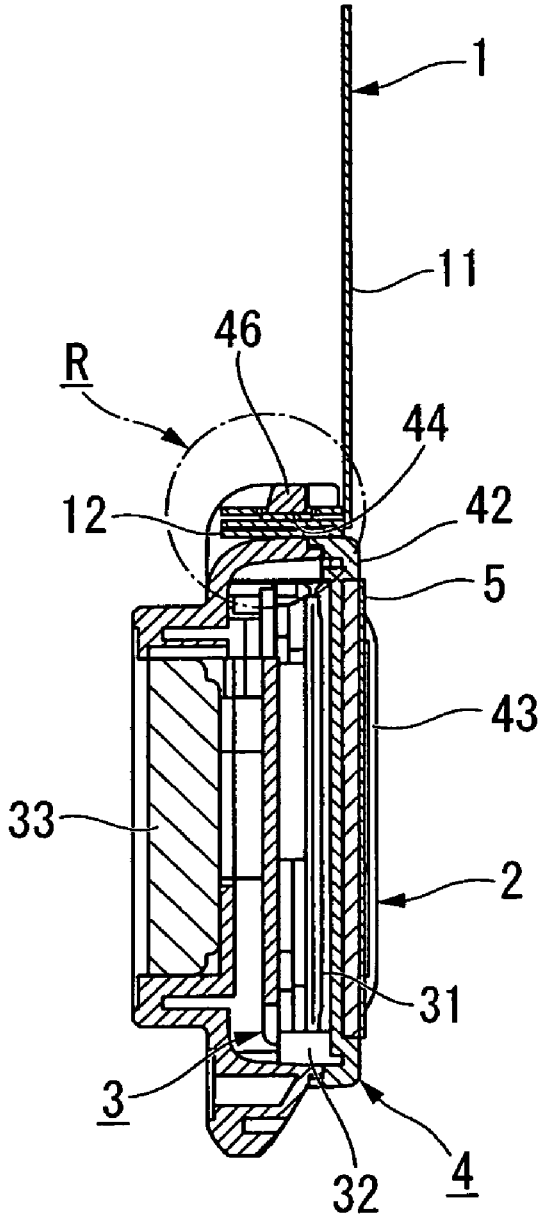
FIG. 9 is a sectional view taken along the arrow D-D of FIG. 7.
Figure 10:
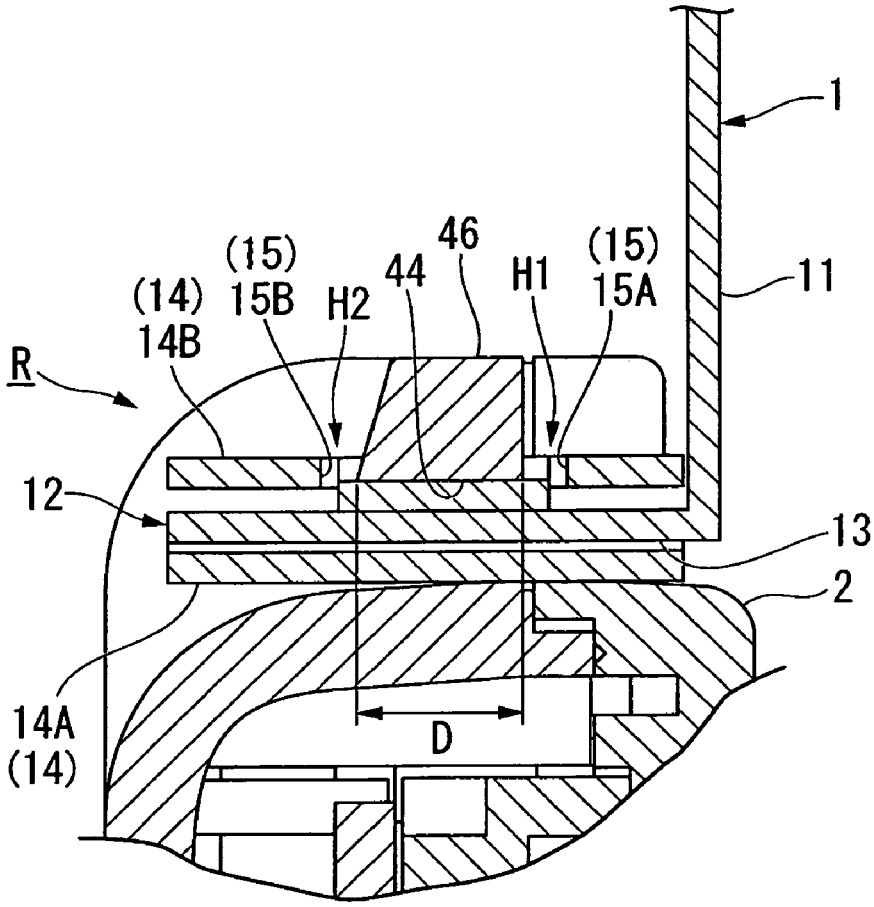
FIG. 10 is a view illustrating a portion represented by reference symbol R illustrated in FIG. 9, and is an enlarged view of a through-hole portion.

FIG. 1 is a perspective view illustrating a schematic structure of the information display panel mounted on an electronic shelf label according to the first embodiment of the present invention. FIG. 2 is a front view of the information display panel. FIGS. 3(*a*) to 3(*d*) are views illustrating procedures of forming a holding portion of the information display panel. FIG. 4 is a perspective view of the information display panel in a state in which the holding portion is formed. FIG. 5(*a*) is a view taken along the arrow A-A of FIG. 4, and FIG. 5(*b*) is a sectional view taken along the arrow B-B of FIG. 4. FIG. 6 is a front view of the electronic shelf label. FIG. 7 is a top view of FIG. 1. FIG. 8 is a view taken along the arrow C-C of FIG. 7. FIG. 9 is a sectional view taken along the arrow D-D of FIG. 7. FIG. 10 is a view illustrating a portion represented by reference symbol R illustrated in FIG. 9, and is an enlarged view of a through-hole portion.

As illustrated in FIG. 1, an information display panel 1 according to the first embodiment is used at, for example, a product shelf in a retail store such as a supermarket, and is attached to an electronic shelf label 2 (shelf label) for displaying a product price in an electronic manner. The information display panel 1 has a function of differentiating, for example, a product on sale with the aid of character information and color-coding as well as displaying a price by the electronic shelf label 2, to thereby attract customers' attention. The information display panel 1 and the electronic shelf label 2 together constitute a display system.

As illustrated in FIG. 2, the information display panel 1 is made of, for example, a bendable material such as paper and a plastic including polyester, and is shaped like a rectangular sheet in plan view. Specifically, the information display panel 1 includes a display body portion 11 capable of displaying arbitrary information, and a holding portion 12 (see FIGS. 4 and 5) formed into a belt shape along one edge of the display body portion 11 (bottom edge portion 11*a*), the holding portion 12 serving as a part to be inserted into a through-hole portion 44 (see FIG. 6) of the electronic shelf label 2 which is described later. Note that, the information to be displayed on the display body portion 11 may be placed in any way, for example, printing, affixing, or handwriting.

In this case, in the information display panel 1, the bottom edge portion 11*a*, at which the holding portion 12 is located, corresponds to the lower edge of the display body portion 11.

The holding portion 12 includes an insertion base end portion 13 provided continuously to one side (left side in a lateral direction) of the bottom edge portion 11*a* of the display body portion 11, a foldable piece 14 (14A and 14B) extending from the insertion base end portion 13 in the direction along the bottom edge portion 11*a*, and a pair of slits 15 (15A and 15B) provided in the foldable piece 14 on an opposite side to the insertion base end portion 13 side in the lateral direction, and formed in parallel to each other along the bottom edge portion 11*a*. In other words, the foldable piece 14 is in a state of being separated off from the display body portion 11 by a slit portion 16 constituting the bottom edge portion 11*a*.

As illustrated in FIGS. 3(*a*) and 3(*b*), the insertion base end portion 13 is bendable in a predetermined direction toward the display body portion 11 (direction toward a back side of a display surface 11*b* of the display body portion 11 (back surface 11*c*), that is, arrow E1 direction) along a bending line S1 (chain line of FIG. 3(*a*)), which is located on an extended line from the slit portion 16 serving as a boundary line between the foldable piece 14 and the display body portion 11. Note that, a bending angle of the insertion base end portion 13 is substantially 90 degrees at this time, and the insertion base end portion 13 defines a substantially right angle with the display body portion 11.

As illustrated in FIG. 2, the foldable piece 14 includes the first piece portion 14A and the second piece portion 14B, which are located on both right and left sides of a substantially intermediate position in the lateral direction (corresponding to a second folding line T2). The insertion base end portion 13, the first piece portion 14A, and the second piece portion 14B are formed with substantially the same linear dimension. Note that, a first folding line T1 (broken line of FIG. 2) serving as the boundary between the insertion base end portion 13 and the foldable piece 14, and the second folding line T2 (broken line of FIG. 2) serving as the boundary between the first piece portion 14A and the second piece portion 14B are each orthogonal to the bending line S1.

Further, the foldable piece 14 is folded twice toward the insertion base end portion 13. Specifically, as illustrated in FIGS. 3(*b*) and 3(*c*), the first piece portion 14A is foldable along the first folding line T1 in a predetermined direction toward the insertion base end portion 13 (direction in which the first piece portion 14A overlaps with a display surface 13*a* of the insertion base end portion 13, that is, arrow E2 direction). Further, as illustrated in FIGS. 3(*c*) and 3(*d*), the second piece portion 14B is foldable along the second folding line T2 in a predetermined direction toward the first piece portion 14A (direction in which the second piece portion 14B overlaps with a back surface 13*b* of the insertion base end portion 13, that is, arrow E3 direction).

As described above, with the structure of the information display panel 1, as illustrated in FIGS. 4, 5(*a*), and 5(*b*), the holding portion 12 which can be inserted into the through-hole portion 44 described later is formed by bending the insertion base end portion 13 along the bending line S1 toward the display body portion 11, then folding the first piece portion 14A along the first folding line T1 toward the insertion base end portion 13, and then folding the second piece portion 14B along the second folding line T2 toward the first piece portion 14A. With the structure of the holding portion 12, elastic force is applied in such a direction as to increase the thickness dimension thereof, that is, in a direction in which the folded first piece portion 14A and the folded second piece portion 14B rotate about the first folding line T1 and the second folding line T2 serving as rotation axes, respectively.

As illustrated in FIG. 2, the slits 15 have appropriate linear dimensions and are formed in the second piece portion 14B in parallel to each other while the two slits 15 are spaced apart at a predetermined distance. In this case, one of the two slits 15 which is located close to the slit portion 16 is referred to as the first slit 15A, and the other one is referred to as the second slit 15B. Further, the distance between the slits 15A and 15B is larger than at least a width dimension D (see FIG. 10) of the through-hole portion 44 described later.

Next, referring to the drawings, description is given of the electronic shelf label 2, to which the information display panel 1 is attached while the holding portion 12 engages therewith.

As illustrated in FIGS. 6 to 9, the electronic shelf label 2 includes an electronic shelf label body 3 having a liquid crystal panel 31 for displaying, for example, a product price, and a shelf label frame 4 for housing the electronic shelf label body 3 thereinside.

As illustrated in FIG. 9, the electronic shelf label body 3 schematically includes the liquid crystal panel 31, a main substrate 32 provided on a back surface side (in FIG. 9, left side) of the liquid crystal panel 31, a battery 33 provided on a back surface side of the main substrate 32, and an antenna 34 attached to an upper portion of the main substrate 32, for receiving, at a terminal (not shown), information to be displayed on the liquid crystal panel 31. For example, memory liquid crystal, which utilizes no electricity, is employed for the electronic shelf label body 3.

As illustrated in FIGS. 6 to 8, the shelf label frame 4 is a housing member having a function of a cover for housing the electronic shelf label body 3 as described above. The shelf label frame 4 schematically includes: a frame-like portion 42 having an opening window 42*a* formed therein, the opening window 42*a* being provided for exposing, on the display surface side, the liquid crystal panel 31 of the electronic shelf label body 3; guide rails 43 (43A and 43B), which are provided on a surface of the frame-like portion 42 and hold a window frame display panel 5 with the window frame display panel 5 inserted thereinto in a longitudinal direction; the through-hole portion 44 for engagement with the holding portion 12 of the information display panel 1; and an antenna housing portion 45 for housing the antenna 34 of the electronic shelf label body 3.

Note that, the window frame display panel 5 is shaped like a frame so as to cover and overlap with a frame part of the frame-like portion 42, and on the frame surface, for example, arbitrary information (for example, character information and color) can be displayed. The window frame display panel 5 is a different display member from the information display panel 1.

The frame-like portion 42 has the substantially rectangular opening window 42*a* formed therein, and the opening window 42*a* has an appropriate size so that the display portion of the liquid crystal panel 31 may be exposed in FIG. 1.

The through-hole portion 44 is formed in a panel attachment portion 46, which is located substantially at the center of the shelf label frame 4 in the lateral direction. Specifically, the panel attachment portion 46 extends from the antenna housing portion 45 in the horizontal direction, and is bent into a hook shape so that the panel attachment portion 46 is connected to an upper frame surface 4*a*. The panel attachment portion 46 has the through-hole portion 44 formed therein (see FIG. 10). The through-hole portion 44 has its cross section shaped like an elongated rectangle, and the shape is substantially the same as that of the cross section of the holding portion 12. In this case, the linear dimension D of the hole of the through-hole portion 44 illustrated in FIG. 10 is smaller than the distance between the above-mentioned two slits 15A and 15B.

Next, referring to the drawings, description is given of effects of the information display panel 1 thus structured.

As illustrated in FIGS. 1, 7, 8, and 9, the holding portion 12 of the information display panel 1 is inserted into the through-hole portion 44 provided in the electronic shelf label 2, and accordingly the information display panel 1 can be held on the electronic shelf label 2. With this structure, it is possible to display character information and the like on the display body portion 11 independently of the price display on the electronic shelf label 2.

Further, the foldable piece 14 is folded so as to overlap with the insertion base end portion 13. Accordingly, the thickness dimension of the holding portion 12 is increased and, due to the folding, elastic force is applied in such a direction as to push out the through-hole portion 44. In other words, a gap is eliminated between the through-hole portion 44 and the holding portion 12, resulting in an improved engaging state of the two portions. In the information display panel 1 of the present invention, in particular, the foldable piece 14 is folded twice, and hence the foldable piece 14 has a double fold with respect to the insertion base end portion 13. Accordingly, the thickness of the holding portion 12 can be increased further and the holding portion 12 can engage with the through-hole portion 44 of the electronic shelf label 2 with no gap.

Further, as illustrated in FIG. 10, the through-hole portion 44 is located between the two slits 15A and 15B. With this structure, part of the holding portion 12 located between the slits 15A and 15B is pressed by the through-hole portion 44 in such a direction as to decrease the thickness dimension thereof counteracting elastic deformation that is caused by folding. As a result, steps H1 and H2 are formed in the slit parts. Therefore, the step H1 of the first slit 15A on one hand (slit close to the display body portion 11) abuts against an end portion of the through-hole portion 44 to regulate the insertion of the holding portion 12, while the step H2 of the second slit 15B on the other hand prevents the holding portion 12 from falling off.

Note that, the information display panel 1 held on the electronic, shelf label 2 can be detached by pulling out the holding portion 12 from the through-hole portion 44 while pushing the holding portion 12 down so as to eliminate the step H2 formed by the second slit 15B.

Further, the steps H1 and H2 formed by the slits 15A and 15B form lines and abut against the through-hole portion 44 along the lines. Accordingly, rocking of the holding portion 12, that is, rotation of the holding portion 12 in the horizontal direction with respect to the through-hole portion 44, can be regulated (see FIG. 7).

Moreover, as illustrated in FIG. 2, in the information display panel 1, the holding portion 12 (insertion base end portion 13 and foldable piece 14) can be arranged along the bottom edge portion 11*a* of the display body portion 11, and hence the holding portion 12 can be formed easily by, for example, slitting the information display panel 1 in the state of the rectangular shape in the portion between the display body portion and the foldable piece. Further, there can be realized such simple engagement structure that formation of the slits 15 in part of the holding portion 12 and other processes do not require much labor and time.

As described above, according to the information display panel and the shelf label of the first embodiment, when the holding portion 12, which has an elastic action produced by folding the foldable piece 14, is inserted into the through-hole portion 44 of the electronic shelf label 2, the through-hole portion 44 and the holding portion 12 are locked by the steps of the slit parts formed by pressing part of the holding portion 12 by the through-hole portion 44 in such a direction as to decrease the thickness dimension thereof, which can prevent the holding portion 12 from falling off from the through-hole portion 44, resulting in an improved engaging state thereof.

Further, the steps H of the slits 15 abut against the through-hole portion 44 along the lines and enter a locked state. Accordingly, rotation of the holding portion 12 in the horizontal direction with respect to the through-hole portion 44 is regulated, which eliminates displacement due to rocking and can enhance stability of the holding portion 12.

Further, there is obtained simple engagement structure in which the slits 15 are only formed in part of the holding portion 12 (foldable piece 14), and accordingly, for example, there is no need to form a protrusion in any one of the through-hole portion and the holding portion, which provides an advantage of facilitating the process.

Next, referring to the drawings, description is given of other embodiments, but members or parts identical or similar to those in the above-mentioned first embodiment are denoted by the same reference symbols to omit their description, and the description is given only of structure different from that of the first embodiment.

Figure 11:
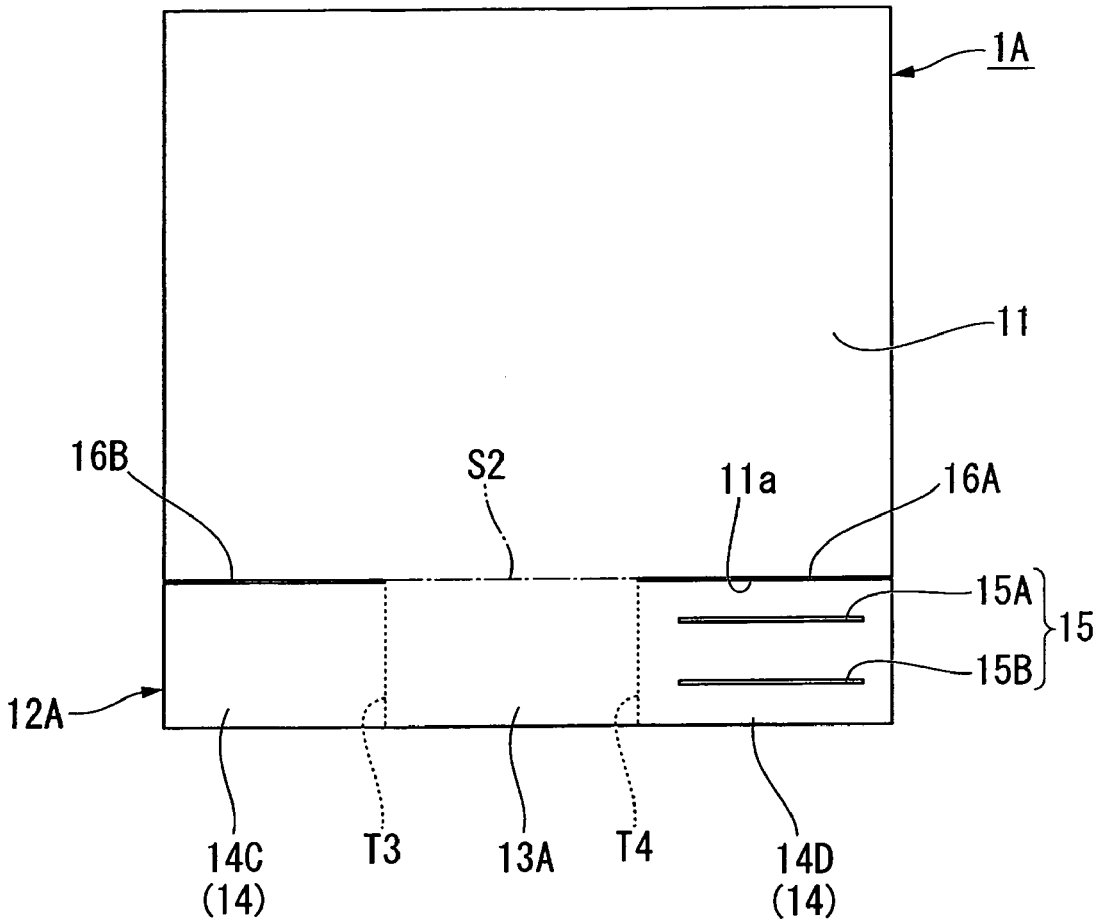
FIG. 11 is a front view of an information display panel according to a second embodiment of the present invention.
Figure 12:
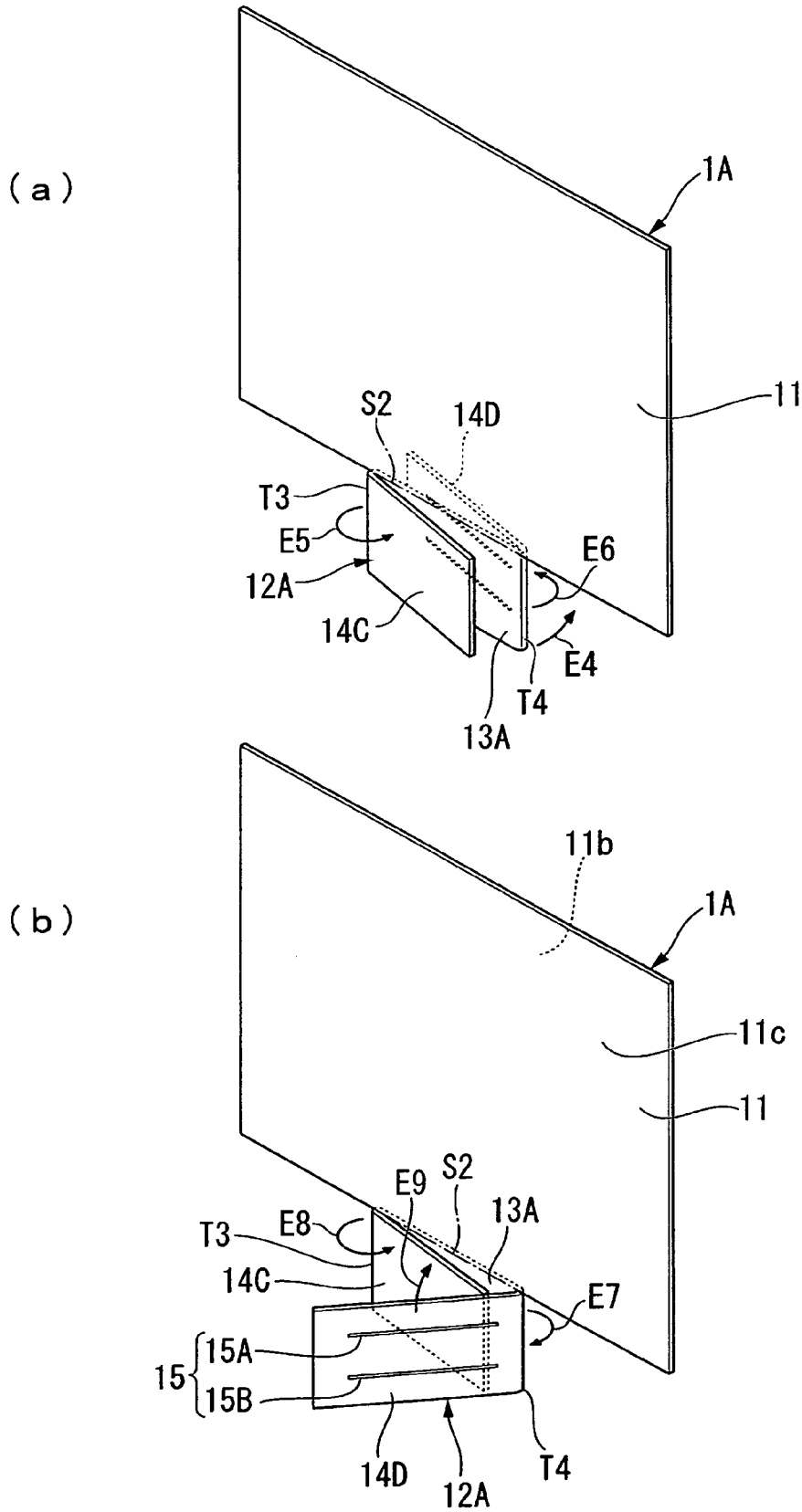
FIGS. 12(*a*)-12(*b*) are perspective views illustrating an overview of forming a holding portion of the information display panel illustrated in FIG. 11, in which FIG. 12(*a*) is a view illustrating a first method and FIG. 12(*b*) is a view illustrating a second method.

FIG. 11 is a front view of an information display panel according to a second embodiment of the present invention. FIGS. 12(*a*)-12(*b*) are perspective views illustrating an overview of forming a holding portion of the information display panel illustrated in FIG. 11, in which FIG. 12(*a*) is a view illustrating a first method and FIG. 12(*b*) is a view illustrating a second method.

The second embodiment is a modification example of the structure of the holding portion 12 (see FIG. 2) of the information display panel 1 according to the above-mentioned first embodiment.

Specifically, as illustrated in FIG. 11, in the structure of a holding portion 12A of an information display panel 1A, an insertion base end portion 13A is arranged substantially at the center of the bottom edge portion 11*a* of the display body portion 11 in the lateral direction, and a foldable piece 14 (third piece portion 14C and fourth piece portion 14D) extends from both sides of the insertion base end portion 13A along the bottom edge portion 11*a* in the horizontal direction. Further, the slits 15A and 15B are formed in the fourth piece portion 14D on one hand (in FIG. 11, right side of the drawing sheet). The insertion base end portion 13A is bent along a bending line S2 (chain line of FIG. 11) in a predetermined direction toward the display body portion 11. Then, both the piece portions 14C and 14D are foldable along folding lines T3 and T4 (broken lines of FIG. 11) in predetermined directions toward the insertion base end portion 13A, respectively (see FIG. 12).

As illustrated in FIG. 12(*a*), the holding portion 12A of the information display panel 1A according to the second embodiment may be formed by the first method. In the first method, the insertion base end portion 13A is bent along the bending line S2 in an arrow E4 direction, and the third piece portion 14C and the fourth piece portion 14D are folded along the folding lines T3 and T4 in an arrow E5 direction and an arrow E6 direction, respectively, so as to overlap with both surfaces of the insertion base end portion 13A.

Alternatively, as illustrated in FIG. 12(*b*), the holding portion 12A of the information display panel 1A according to the second embodiment may be formed by the second method. In the second method, the insertion base end portion 13A is bent along the bending line S2 in an arrow E7 direction toward the back surface 11*c* of the display body portion 11, and both the piece portions 14C and 14D are folded along the folding lines T3 and T4 in an arrow E8 direction and an arrow E9 direction, respectively, so as to overlap with the insertion base end portion 13A on the same surface side thereof. In the case of FIG. 12(*b*), the display surface 11*b* of the display body portion 11 is located on the back side of the drawing sheet.

Figure 13:
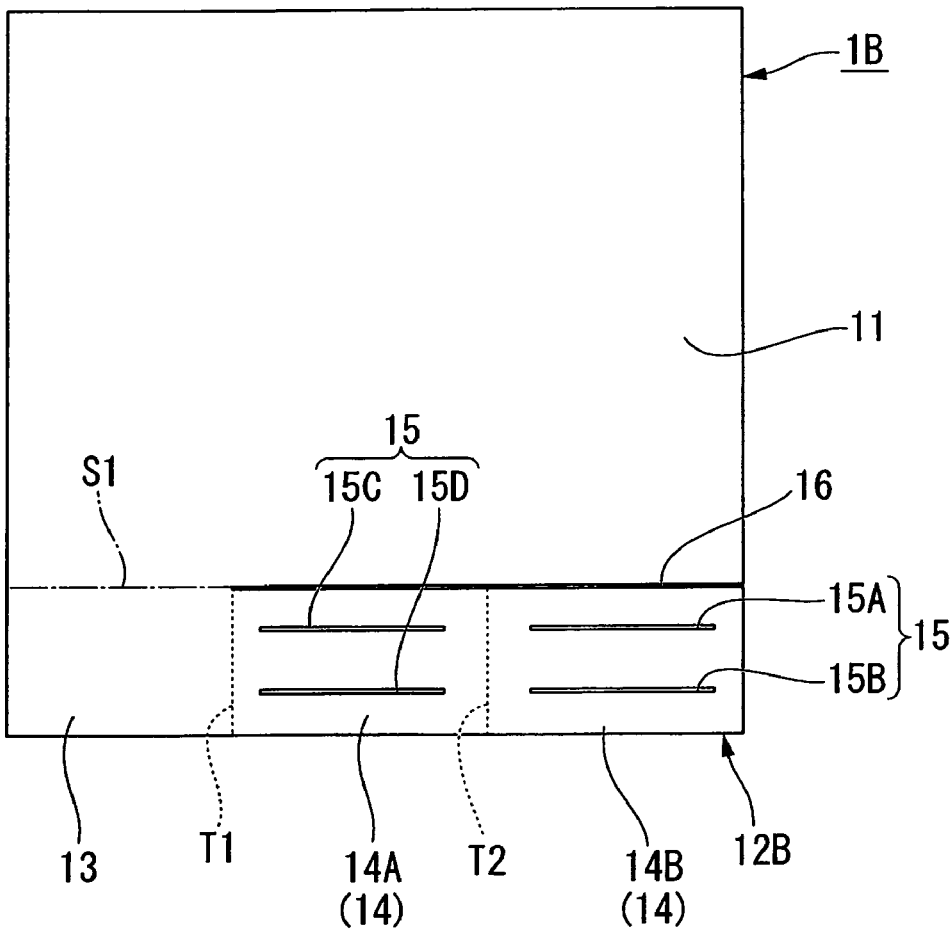
FIG. 13 is a front view of an information display panel according to a third embodiment of the present invention.
Figure 14:
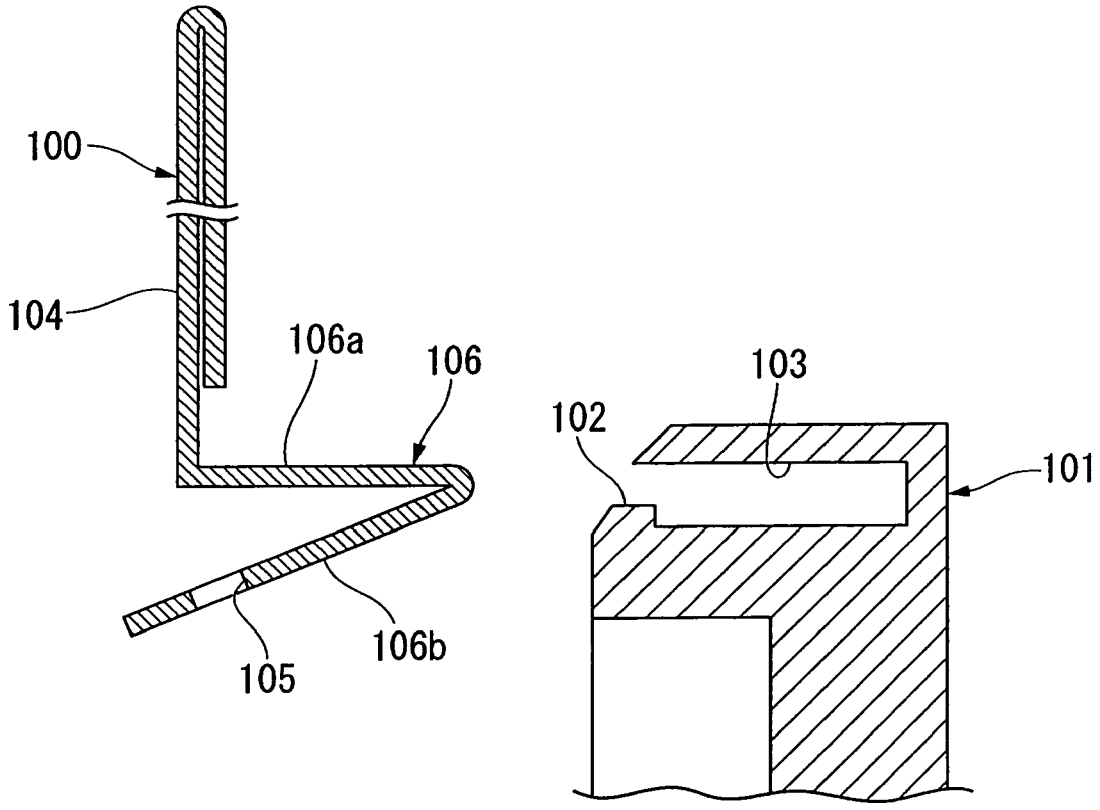
FIG. 14 is a view illustrating an example of conventional attachment structure for an information display panel.

Next, FIG. 13 is a front view of an information display panel according to a third embodiment of the present invention.

An information display panel 1B according to the third embodiment illustrated in FIG. 13 is obtained by forming, in the information display panel 1 (see FIG. 2) according to the above-mentioned first embodiment, a holding portion 12B having slits 15 (15C and 15D) also provided in the first piece portion 14A. The holding portion 12B is formed by the same procedures as illustrated in FIG. 3. Under a state in which the holding portion 12B is formed, the second piece portion 14B having the slits 15A and 15B formed therein is arranged on the upper side of the holding portion 12B, and the first piece portion 14A having the slits 15C and 15D formed therein is arranged on the lower side of the holding portion 12B. In the third embodiment, the slits 15 are provided in the upper and lower surfaces of the holding portion 12B, and hence the steps can be formed by the slits 15 in the upper and lower portions of the through-hole portion (see FIG. 10) of the electronic shelf label, resulting in a further improved engaging state thereof.

Hereinabove, the description is given of the information display panel and the shelf label according to each of the first to the third embodiments of the present invention, but the present invention is not limited to the above-mentioned embodiments, and appropriate modifications may be made thereto without departing from the gist of the present invention.

For example, in the embodiments of the present invention, two slits 15 are provided in one place, but the present invention is not limited thereto, and three or more slits may be provided so as to correspond to the shape of the through-hole portion. For example, in a case where two through-hole portions are coaxially arranged at a given distance, four slits may be provided so as to correspond to the positions of the through-hole portions.

Further, in the embodiments of the present invention, the holding portion is formed in such a manner that the foldable piece 14 is folded so as to doubly overlap with each of the insertion base end portions 13 and 13A, but the present invention is not limited to such a type, and a single, triple, or more fold may be formed by the foldable piece 14. What is important is that the holding portion is formed with an appropriate thickness dimension that allows the holding portion to be inserted into the through-hole portion.

Further, in the structure according to the embodiments of the present invention, the slits 15 are formed in the foldable piece 14, but the present invention is not limited thereto, and the slits 15 may be formed in the insertion base end portion 13, or the slits 15 may instead be formed both in the insertion base end portion 13 and the foldable piece 14. What is important is that, under the state in which the holding portion 12 is formed by folding the foldable piece 14, the slits 15 are arranged in at least one of the upper and lower surfaces of the holding portion 12 which is held in contact with the through-hole portion for holding the information display panel.

Further, the size of the display body portion of the information display panel, the thickness dimension of the holding portion, and the linear dimensions of the slits may be set arbitrarily.

Still further, in the embodiments of the present invention, the electronic shelf label 2 is applied as a subject to which one of the information display panels 1, 1A, and 1B is attached, but the present invention is not limited to the electronic shelf label 2 having a liquid crystal panel, and a shelf label with manually-switchable display and a shelf label with printed display are also applicable.

The present invention is available for an information display panel and a shelf label, which are used for displaying a product price, character information, and the like in a retail store and the like.

Reference Signs List

1, 1A, 1B information display panel
2 electronic shelf label (shelf label)
3 electronic shelf label body
4 shelf label frame
11 display body portion
12, 12A, 12B holding portion
13, 13A insertion base end portion
14 foldable piece
14A-14D first to fourth piece portions
15, 15A-15D slit
16 slit portion
H1, H2 step
S1, S2 bending line
T1-T4 folding line

The invention claimed is:

1. An information display panel configured to be held by a through-hole portion provided in a shelf label, the information display panel comprising:

a display body portion configured to display arbitrary information;

an insertion base end portion provided continuously to a bottom edge portion of the display body portion, the insertion base end portion being bent with respect to the display body portion along a boundary line between the insertion base end portion and the display body portion;

a foldable piece extending from the insertion base end portion in a direction along the bottom edge portion, the foldable piece being folded so as to overlap with the insertion base end portion to thereby form a holding portion configured to be inserted into the through-hole portion of the shelf label; and a plurality of slits formed in at least one of the insertion base end portion and the foldable piece so as to extend parallel to each other along the bottom edge portion, the plurality of slits being arranged in at least one of upper and lower surfaces of the holding portion.

2. An information display panel according to claim 1; wherein the foldable piece is folded at least twice in a direction extending from the insertion base end portion.

3. An information display panel according to claim 2; wherein at least two of the plurality of slits have a distance therebetween with substantially the same dimension as a linear dimension of the through-hole portion of the shelf label.

4. A shelf label comprising the through-hole portion configured to hold the information display panel according to claim 3.

5. A shelf label comprising the through-hole portion configured to hold the information display panel according to claim 2.

6. A shelf label comprising the through-hole portion configured to hold the information display panel according to claim 1.

7. An information display panel according to claim 1; wherein at least two of the plurality of slits have a distance therebetween with substantially the same dimension as a linear dimension of the through-hole portion of the shelf label.

8. An information display panel configured to be held by a shelf label for displaying information, the information display panel comprising:

a display body portion for displaying information; and a holding portion formed along one edge of the display body portion and having a pair of slits, the holding portion being configured for insertion into a through-hole portion of the shelf label so as to form steps in the respective slits by which the holding portion is engaged with the through-hole portion of the shelf label to thereby hold the information display panel.

9. An information display panel according to claim 8; wherein the holding portion comprises a base end portion bendable along the one edge of the display body portion and a foldable portion folded so as to overlap with the base end portion.

10. An information display panel according to claim 9; wherein the foldable portion is folded at least twice in a direction extending from the base end portion.

11. An information display panel according to claim 10; wherein the pair of slits are separated by a distance having substantially the same dimension as a linear dimension of the through-hole portion of the shelf label.

12. An information display panel according to claim 8; wherein the pair of slits are separated by a distance having substantially the same dimension as a linear dimension of the through-hole portion of the shelf label.

13. An information display panel according to claim 8; wherein the pair of slits are disposed parallel to one another.

14. An information display panel according to claim 13; wherein the pair of slits are arranged in at least one of upper and lower surfaces of the holding portion.

15. An information display panel according to claim 8; wherein the pair of slits are arranged in at least one of upper and lower surfaces of the holding portion.

16. A display system comprising:

a shelf label configured to display product information, the shelf label having a through-hole portion; and an information display panel configured to be held by the shelf label for displaying information corresponding to the product information displayed by the shelf label, the information display panel having a display body portion for displaying the information, a base end portion extending from an edge of the display body portion, and a foldable portion extending from the base end portion and being folded so as to overlap with the base end portion to form a holding portion configured to be inserted into the through-hole portion of the shelf label so, that the information display panel is held by the shelf label.

17. A display system according to claim 16;

wherein the holding portion of the information display panel has a pair of slits; wherein when the holding portion is inserted into the through-hole portion of the shelf label, the pair of slits forming respective steps by which the holding portion is engaged with the through-hole portion of the shelf label to thereby hold the information display panel.

18. An information display panel according to claim 16; wherein the pair of slits are arranged in at least one of upper and lower surfaces of the holding portion in parallel relation to one another.

* * * * *